US008905084B2

(12) United States Patent
Shih

(10) Patent No.: US 8,905,084 B2
(45) Date of Patent: Dec. 9, 2014

(54) TUBE OF RADIATOR

(71) Applicant: Cryomax Cooling System Corp., Changhua County (TW)

(72) Inventor: Po-Wen Shih, Changhua County (TW)

(73) Assignee: Cryomax Cooling System Corp., Changhua County (TW)

( * ) Notice: Subject to any disclaimer, the term of this patent is extended or adjusted under 35 U.S.C. 154(b) by 0 days.

(21) Appl. No.: 13/707,701

(22) Filed: Dec. 7, 2012

(65) Prior Publication Data

US 2014/0158248 A1 Jun. 12, 2014

(51) Int. Cl.
*F16L 9/14* (2006.01)
*F28F 1/00* (2006.01)

(52) U.S. Cl.
CPC ..... *F28F 1/00* (2013.01)
USPC ..... 138/153; 138/163; 138/169; 138/171

(58) Field of Classification Search
USPC ..... 138/153, 163, 169, 171
See application file for complete search history.

(56) References Cited

U.S. PATENT DOCUMENTS 1,929,898 A * 10/1933 Murray, Jr. ..... 219/67
1,993,065 A * 3/1935 Light ..... 29/890.05
2,172,429 A * 9/1939 Yates ..... 138/152
2,373,218 A * 4/1945 Arnold ..... 138/38
2,655,944 A * 10/1953 Proehl ..... 138/38
2,706,328 A * 4/1955 Karmazin ..... 228/144
3,149,667 A * 9/1964 Astrup ..... 165/134.1
4,168,737 A * 9/1979 Yoshimitsu ..... 165/76
5,467,816 A * 11/1995 Larinoff ..... 165/151
5,915,421 A * 6/1999 Borzym et al. ..... 138/142
6,293,313 B1 * 9/2001 McCrink ..... 138/172
2008/0105322 A1 * 5/2008 Kaimura et al. ..... 138/115

* cited by examiner

*Primary Examiner* — James Hook

(74) *Attorney, Agent, or Firm* — Alan Kamrath; Kamrath IP Lawfirm, P.A.

(57) ABSTRACT

A tube of a radiator includes a tube body, and a reinforcement strip. The tube body has a first curved face and a second curved face. The tube body is formed by a sheet plate which has two opposite ends connected to form a connecting portion which is located at the first curved face of the tube body. The reinforcement strip is mounted in the sheet plate and is located at the second curved face of the tube body. Thus, the first curved face of the tube body is formed with the connecting portion, and the second curved face of the tube body is combined with the reinforcement strip so that both of the first curved face and the second curved face of the tube body have a larger thickness to enhance the stiffness and strength of the tube body.

7 Claims, 6 Drawing Sheets

TUBE OF RADIATOR

BACKGROUND OF THE INVENTION

1. Field of the Invention

The present invention relates to a tube and, more particularly, to a tube of a radiator for cooling the engine of a car.

2. Description of the Related Art

A conventional radiator of the engine of a car in accordance with the prior art shown in FIGS. 1 and 2 comprises a radiator core. The radiator core includes a plurality of tubes 10, and a plurality of cooling fins 12 connected with the tubes 10. Each of the tubes 10 has a first side formed with a first curved face "A" and a second side formed with a second curved face "B" which is located opposite to the first curved face "A". Each of the tubes 10 is formed by a sheet plate which is made of aluminum material. The sheet plate of each of the tubes 10 has two opposite ends connected with each other to form a connecting portion 11. The connecting portion 11 of the sheet plate is located at the first curved face "A" of each of the tubes 10. The second curved face "B" of each of the tubes 10 has a thickness smaller than that of the first curved face "A" so that the second curved face "B" of each of the tubes 10 has a weaker strength. Thus, when the tubes 10 are subjected to the thermal expansion and contraction, the stress and the shock during the cooling process, the second curved face "B" of each of the tubes 10 easily produces breaches "B1" during a long-term utilization, thereby decreasing the lifetime of each of the tubes 10, and thereby easily producing leakage.

BRIEF SUMMARY OF THE INVENTION

In accordance with the present invention, there is provided a tube of a radiator, comprising a hollow tube body, and a reinforcement strip mounted on the tube body. The tube body has a first side formed with a first curved face and a second side formed with a second curved face which is located opposite to the first curved face. The tube body is formed by a sheet plate which is made of aluminum material. The sheet plate has two opposite ends connected with each other and forming a connecting portion. The two opposite ends of the sheet plate are connected with each other by soldering. The connecting portion of the sheet plate is located at the first curved face of the tube body. The reinforcement strip is mounted in the sheet plate and is located at the second curved face of the tube body to reinforce the second curved face of the tube body. The second curved face of the tube body is reinforced by the reinforcement strip so that the first curved face and the second curved face of the tube body have a predetermined thickness to enhance the stiffness and strength of the tube body.

The tube body has a flat shape. the reinforcement strip has a substantially U-shaped cross-sectional profile and abuts an inner face of the sheet plate.

When the tube body is expanded in a planar shape before assembly, the sheet plate functions as a primary material with a determined area, and the reinforcement strip functions as a secondary material which is combined with the primary material of the sheet plate by a soldering agent. The secondary material of the reinforcement strip is extended in a longitudinal direction of the primary material of the sheet plate.

The primary objective of the present invention is to provide a tube with enhanced stiffness and strength.

According to the primary advantage of the present invention, the first curved face of the tube body is formed with the connecting portion, and the second curved face of the tube body is combined with the reinforcement strip so that both of the first curved face and the second curved face of the tube body have a predetermined larger thickness to enhance the stiffness and strength of the tube body.

According to another advantage of the present invention, the tube body has greater stiffness and strength so that the tube body can resist the thermal expansion and contraction, the stress and the shock during the cooling process and will not be broken or worn out during a long-term utilization, thereby enhancing the lifetime of the tube body, and thereby preventing the tube body from producing leakage.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
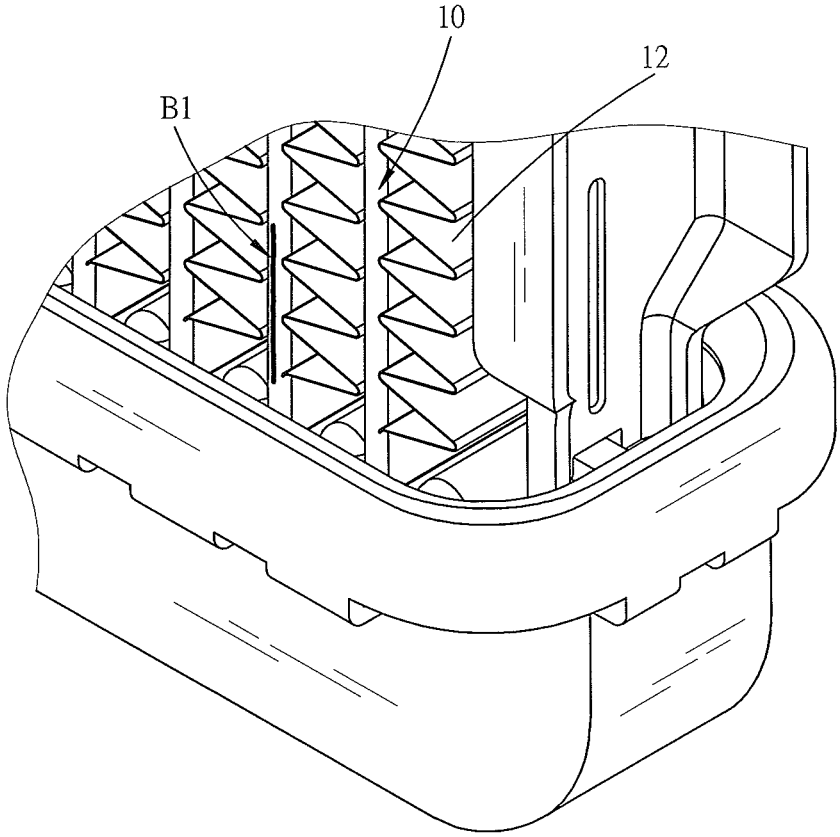
FIG. 1 PRIOR ART
FIG. 1 is a partially perspective view of a conventional tube of a radiator in accordance with the prior art.
Figure 2:
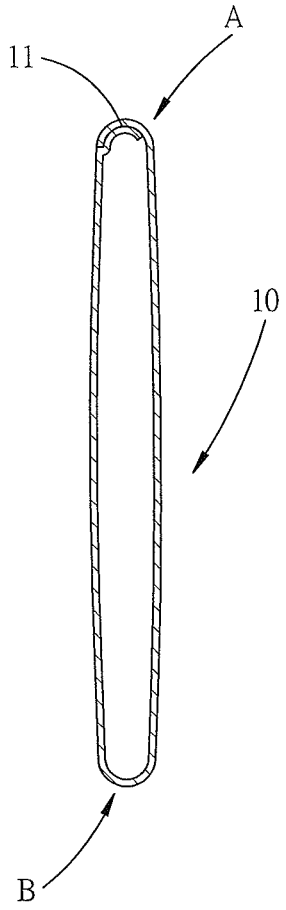
FIG. 2 PRIOR ART
FIG. 2 is a top cross-sectional view of the conventional tube of a radiator as shown in FIG. 1.
Figure 3:
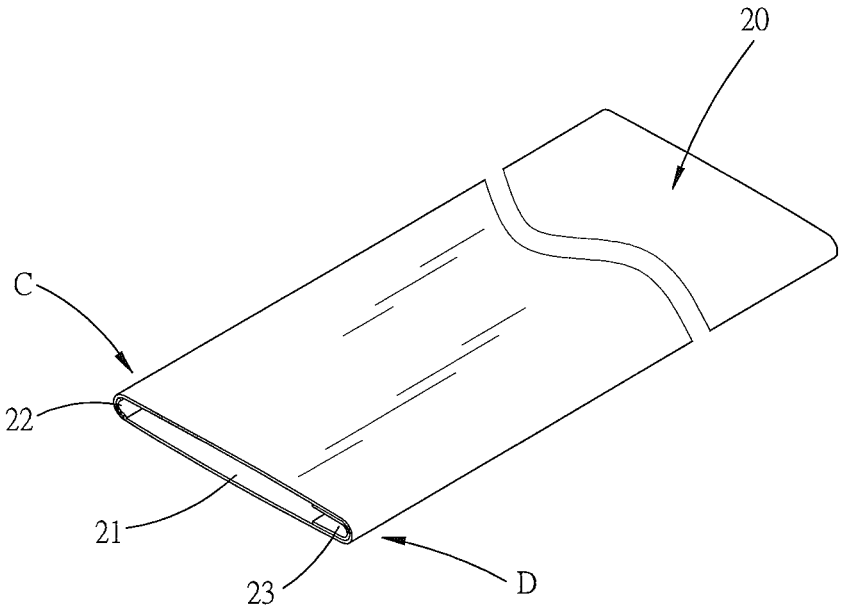
FIG. 3 is a perspective view of a tube of a radiator in accordance with the preferred embodiment of the present invention.
Figure 4:
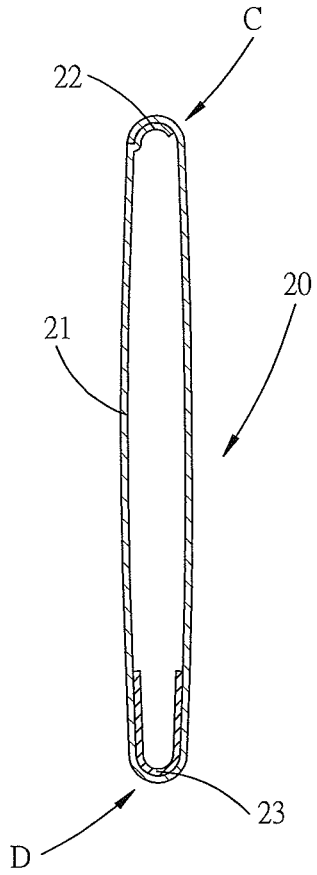
FIG. 4 is a side cross-sectional view of the tube of a radiator as shown in FIG. 3.

Referring to the drawings and initially to FIGS. 3 and 4, a tube of a radiator in accordance with the preferred embodiment of the present invention comprises a hollow tube body 20, and a reinforcement strip 23 mounted on the tube body 20.

The tube body 20 has a flat shape. The tube body 20 has a first side formed with a first curved face "C" and a second side formed with a second curved face "D" which is located opposite to the first curved face "C". The tube body 20 is formed by a sheet plate 21 which is made of aluminum material. The sheet plate 21 has two opposite ends connected with each other and forming a connecting portion 22. The two opposite ends of the sheet plate 21 are connected with each other by soldering. The connecting portion 22 of the sheet plate 21 is located at the first curved face "C" of the tube body 20.

The reinforcement strip 23 is mounted in the sheet plate 21 and is located at the second curved face "D" of the tube body 20 to reinforce the second curved face "D" of the tube body 20. The reinforcement strip 23 is located opposite to the connecting portion 22 of the sheet plate 21. In the preferred embodiment of the present invention, the reinforcement strip 23 has a substantially U-shaped cross-sectional profile and abuts an inner face of the sheet plate 21. In such a manner, the second curved face "D" of the tube body 20 is reinforced by the reinforcement strip 23 so that the first curved face "C" and the second curved face "D" of the tube body 20 have the same thickness to enhance the stiffness and strength of the tube body 20.

Figure 5:
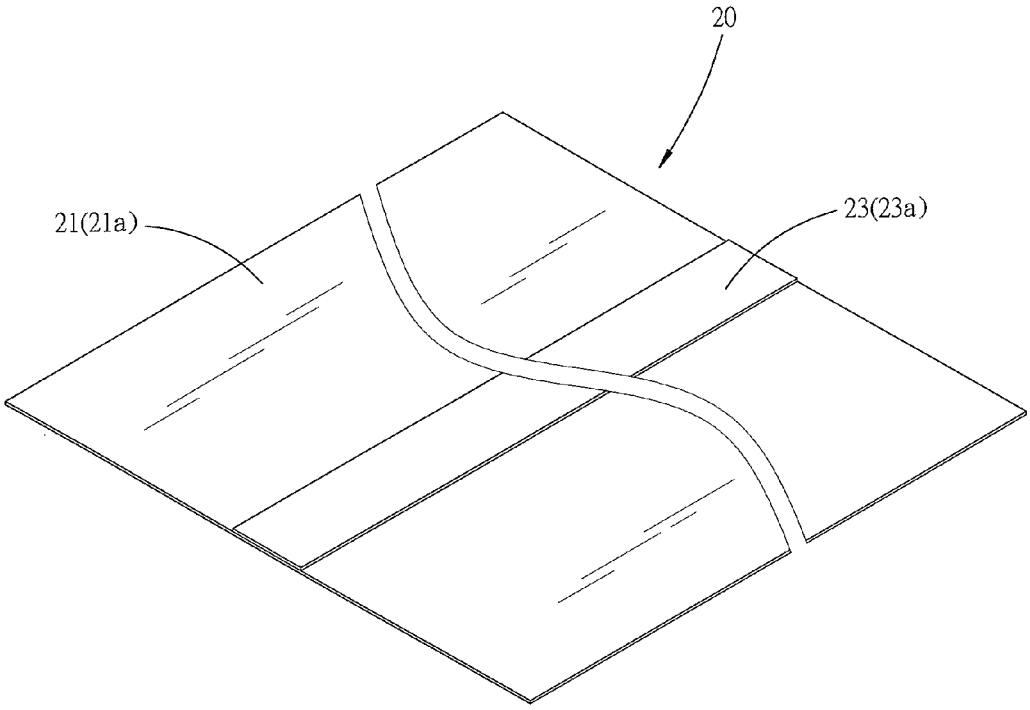
FIG. 5 is a perspective expanded view of the tube of a radiator as shown in FIG. 3.

Referring to FIG. 5 with reference to FIGS. 3 and 4, when the tube body 20 is expanded in a planar shape before assembly, the sheet plate 21 functions as a primary material 21*a* with a determined area, and the reinforcement strip 23 functions as a secondary material 23*a* which is combined with the primary material 21*a* of the sheet plate 21 by a soldering agent. The secondary material 23*a* of the reinforcement strip 23 is located at a middle position of and extended in a longitudinal direction of the primary material 21*a* of the sheet plate 21.

Figure 6:
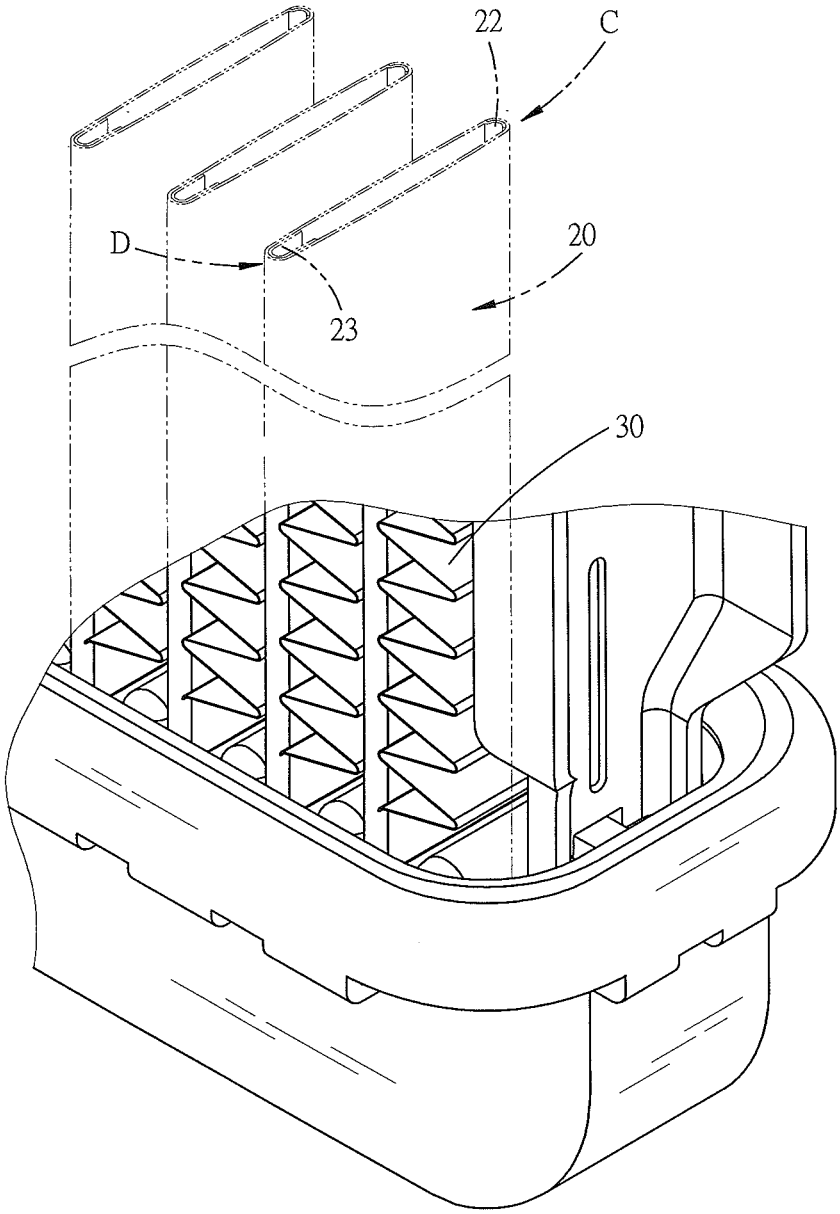
FIG. 6 is a schematic operational view of the tube of a radiator as shown in FIG. 3 in use.

Referring to FIG. 6 with reference to FIGS. 3 and 4, a plurality of tubes are connected with a plurality of cooling fins 30 to form a radiator core which is mounted in a car radiator for cooling the engine of a car. The tube body 20 of each of the tubes is subjected frequently to the effect of thermal expansion and contraction and to the effect of shock during the cooling process of the engine. In practice, both of the first curved face "C" and the second curved face "D" of the tube body 20 have a predetermined thickness to enhance the stiffness and strength of the tube body 20 so that the tube body 20 can resist the thermal expansion and contraction and can resist the shock or vibration.

Accordingly, the first curved face "C" of the tube body 20 is formed with the connecting portion 22, and the second curved face "D" of the tube body 20 is combined with the reinforcement strip 23 so that both of the first curved face "C" and the second curved face "D" of the tube body 20 have a predetermined larger thickness to enhance the stiffness and strength of the tube body 20. In addition, the tube body 20 has greater stiffness and strength so that the tube body 20 can resist the thermal expansion and contraction, the stress and the shock during the cooling process and will not be broken or worn out during a long-term utilization, thereby enhancing the lifetime of the tube body 20, and thereby preventing the tube body 20 from producing leakage.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A tube of a radiator, comprising:

a hollow tube body; and a reinforcement strip mounted on the tube body; wherein:

the tube body has a first side formed with a first curved face and a second side formed with a second curved face which is located opposite to the first curved face;

the tube body is formed by a sheet plate which is made of aluminum material;

the sheet plate has two opposite ends connected with each other and forming a connecting portion;

the two opposite ends of the sheet plate are connected with each other by soldering;

the connecting portion of the sheet plate is located at the first curved face of the tube body;

the reinforcement strip is located opposite to and aligned with the connecting portion;

the reinforcement strip is mounted inside the sheet plate and is located at the second curved face of the tube body to reinforce the second curved face of the tube body;

the reinforcement strip partially covers the interior of the sheet plate so that the tube has a lighter weight and a simpler structure with less material; and the second curved face of the tube body is reinforced by the reinforcement strip so that the first curved face and the second curved face of the tube body have a predetermined thickness to enhance the stiffness and strength of the tube body.

2. The tube of a radiator of claim 1, wherein the tube body has a flat shape, and the reinforcement strip has a substantially U-shaped cross-sectional profile and abuts an inner face of the sheet plate.

3. The tube of a radiator of claim 1, wherein when the tube body is expanded in a planar shape before assembly, the sheet plate functions as a primary material with a determined area, and the reinforcement strip functions as a secondary material which is combined with the primary material of the sheet plate by a soldering agent, and the secondary material of the reinforcement strip is extended in a longitudinal direction of the primary material of the sheet plate.

4. The tube of a radiator of claim 1, wherein the tube body has two opposite flat walls defined between the first curved face and the second curved face, and the reinforcement strip and the connecting portion are spaced by the two flat walls of the tube body.

5. The tube of a radiator of claim 4, wherein the reinforcement strip and the connecting portion are located at two opposite ends of each of the two flat walls of the tube body.

6. The tube of a radiator of claim 4, wherein the reinforcement strip extends through a length that is shorter than a whole length of each of the two flat walls of the tube body.

7. The tube of a radiator of claim 4, wherein the reinforcement strip and the second curved face of the tube body have a total thickness that is greater than a thickness of each of the two flat walls of the tube body.

* * * * *